US006818106B2

(12) United States Patent
D'Astolfo et al.

(10) Patent No.: US 6,818,106 B2
(45) Date of Patent: Nov. 16, 2004

(54) INERT ANODE ASSEMBLY

(75) Inventors: LeRoy E. D'Astolfo, Lower Burrell, PA (US); Calvin Bates, Monroeville, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/713,798

(22) Filed: Nov. 13, 2003

(65) Prior Publication Data

US 2004/0094409 A1 May 20, 2004

Related U.S. Application Data

(63) Continuation-in-part of application No. 10/056,915, filed on Jan. 25, 2002, now abandoned.

(60) Provisional application No. 60/428,818, filed on Nov. 25, 2002.

(51) Int. Cl.[7] ..... B01D 59/40; C25C 3/00; C25B 11/04

(52) U.S. Cl. ..... 204/243.1; 204/244; 204/245; 204/291

(58) Field of Search ..... 204/243.1–247.1, 204/291

(56) References Cited

U.S. PATENT DOCUMENTS

| | | | | | |
|---|---|---|---|---|---|
| 4,265,717 | A | | 5/1981 | Wiltzius | 204/67 |
| 5,098,530 | A | * | 3/1992 | Sudholter et al. | 205/350 |
| 5,279,715 | A | | 1/1994 | La Camera et al. | 204/64 |
| 5,928,717 | A | | 7/1999 | Cherico et al. | 427/140 |
| 6,126,799 | A | | 10/2000 | Ray et al. | 204/291 |
| 6,217,739 | B1 | | 4/2001 | Ray et al. | 205/385 |
| 6,372,119 | B1 | | 4/2002 | Ray et al. | 205/387 |
| 6,423,195 | B1 | | 7/2002 | Ray et al. | 204/291 |
| 6,551,489 | B2 | | 4/2003 | D'Astolfo, Jr. et al. | 205/389 |
| 6,558,526 | B2 | | 5/2003 | D'Astolfo, Jr. et al. | 205/389 |
| 2003/0209426 | A1 | * | 11/2003 | Slaugenhaupt et al. | 204/247.4 |

* cited by examiner

*Primary Examiner*—Donald R. Valentine
(74) *Attorney, Agent, or Firm*—Eckert Seamans; Daniel P. Cillo; Tracey D Beiriger

(57) ABSTRACT

A solid material (12') circumscribing an anode system (10) in an electrolysis apparatus is made from a mixture of cryolite and/or alumina ($Al_2O_3$), where the solid material (12') contacts and surrounds the anodes (14, 14').

14 Claims, 4 Drawing Sheets

INERT ANODE ASSEMBLY

CROSS-REFERENCE TO RELATED APPLICATION

The instant application is a Continuation-in-Part application of U.S. Ser. No. 10/056,915, filed Jan. 25, 2002 now abandoned. Priority is claimed under 35 U.S.C. 119(e) based upon U.S. Provisional Application No. 60/428,818 filed Nov. 25, 2002.

FIELD OF THE INVENTION

The present invention relates to structures and methods for protecting inert anodes and other electrodes and electrode support materials from degradation by a cryolite-based molten electrolyte bath, and from $HF/O_2$ and other gases generated in an electrolytic cell. The present invention also improves metal production, such as aluminum production, by limiting bath and metal contamination and reducing thermal shock during initial preheating and placement of anodes in electrolytic cells.

BACKGROUND OF THE INVENTION

Aluminum is produced conventionally by the electrolysis of alumina dissolved in cryolite-based molten electrolytes at temperatures between about 850° C. and 1000° C.; the process is known as the Hall-Heroult process. This process is well known and described for example in U.S. Patent Specification No. 5,279,715 (La Camera et al.) A Hall-Heroult reduction cell typically comprises a steel shell having an insulating lining of refractory material, which in turn has a lining of carbon that contacts the molten constituents. The electrolyte is based on molten cryolite ($Na_3AlF_6$) which may contain a variety of additives such as LiF, $CaF_2$, $MgF_2$ or $AlF_3$, and contains dissolved high purity alumina ($Al_2O_3$). The carbon lining has a useful life of three to eight years, or even less under adverse conditions. The deterioration of the cathode bottom is due to erosion and penetration of electrolyte and liquid aluminum as well as intercalation of sodium, which causes swelling and deformation of the cathode carbon blocks. In addition, the penetration of sodium species, other substances contained in cryolite, or air leads to the formation of toxic compounds including cyanides. Anodes are at least partially submerged in the bath and are subject to the same conditions.

The Hall process, although commercial today, has certain limitations, such as the requirement that the process operate at relatively high temperatures, typically around 970° C. to 1000° C. The high cell temperatures are necessary to achieve a high alumina solubility. At these temperatures, the electrolyte and molten aluminum progressively react with most carbon or ceramic materials, creating problems of electrode erosion, which can cause cell contamination and metal and electrolyte containment. Thus, it is generally thought that the electrolyte constituents are adverse to the rest of the cell.

Electrolytic reduction cells must be heated from room temperature to approximately the desired 1000° C. operating temperature before the productions of metal can be initiated. Heating should be done gradually and evenly to avoid thermal shock to the cell components which can in turn cause breakage or spalling. The heating operation minimizes thermal shock to the lining, the electrodes and other attached structural assemblies upon introduction of the electrolyte and molten metal to the cell. Prior art carbon anodes can be placed into the electrolyte at ambient temperature, and heated by the energy of the cell to operating temperatures, at which time the nominal current of the anode will be attained.

Newer, ceramic inert anodes have much longer lives, but both the anodes and their supports are prone to thermal shock and therefore generally need to be preheated in a furnace or the like outside of the electrolytic cell prior to insertion into the hot electrolyte. The thermal shock/cracking can occur both during movement of the anodes into position and during their placement into the molten salt. Thermal shock relates to the thermal gradient (positive or negative) through the anode that occurs during the movement from the preheat furnace to the cell, and also upon insertion of the anodes into the molten salt. A thermal gradient as low as 50° C. can cause cracking.

A variety of attempts have been made to introduce various particulates into the inert anode or to cover them with various protective materials, but it is virtually impossible to prevent some dissolution, and eventually such attempts lead to a certain amount of contamination of the bath and aluminum being produced. In one attempt to protect electrodes in an electrolysis cell from thermal shock during start-up, U.S. Patent Specification No. 4,265,717 (Wiltzius), taught protection of hollow cylindrical $TiB_2$ cathodes by inserting aluminum alloy plugs into the cathode cavity and further protecting the cathode with a heat dispersing metal jacket having an inside heat insulating layer contacting the $TiB_2$. There, the heat insulating layer was made of expanded, fibrous kaolin-china clay ($Al_2O_3$ 2$SiO_2$ 2$H_2O$), which would subsequently dissolve in the molten electrolyte, introducing Si. A refractory repair mass is taught in U.S. Patent Specification No. 5,928,717 (Cherico et al.). There, a powder mixture of alumina, metallic combustible such as magnesium, zirconium, chromium and aluminum plus additive selected from aluminum fluoride, barium sulfate, cerium oxide or calcium fluoride are used with an oxygen stream, under pressure, to contact and cure non-uniform crystalline structures and the like at the surface of used refractory. This however, primarily relates to repair and to already present refractories which have been contacted with molten aluminum or molten glass.

In the design of inert anodes for aluminum or other metals production, an array or assembly of uncovered inert anodes can be mounted on a cast refractory insulating lid below a metal plate, through which a continuous electrical path from the cell is provided. In this arrangement, shown in FIG. 3 of U.S. Patent Specification Nos. 6,551,489 B2 and 6,558,526 B2 (both D'Astolfo Jr. et al.), it is necessary to provide protection of the metal plate and cast refractory. The problem, however, is that most refractory materials are not able to withstand the severe thermal shock and gradients encountered during preheat operations without cracking or to withstand a certain amount of dissolution during cell operation. This design is costly and requires a major amount of assembly.

Aluminum electrolysis cells have historically employed carbon anodes on a commercial scale. The energy consumption and cost of aluminum smelting can be significantly reduced with the use of inert, non-consumable, and dimensionally stable anodes. Use of inert anodes rather than traditional carbon anodes allows a highly productive cell design to be utilized, thereby reducing capital costs. Significant environmental benefits are also realized because inert anodes produce essentially no $CO_2$ or $CF_4$ emissions.

Inert anodes can be made of, for example a ceramic, metal ceramic "cermet" or metal containing material. Some examples of ceramic inert anode compositions are provided in U.S. Patent Specification Nos. 6,126,799; 6,217,739 B1; 6,372,119 B1; and 6,423,195 B1 (all Ray et al. respectively), herein incorporated by reference. These anodes comprise a ceramic phase and may also comprise a metal phase. They are essentially void free and while they exhibit low solubility and good dimensional stability there is still some corrosion in Hall cell baths at 1000° C.

In addition to electrode thermal shock problems and electrode support and other cell erosion and contamination problems, an improved, simplified and more cost effective overall design of the electrode/electrode support is needed.

SUMMARY OF THE INVENTION

It is one of the main objects of this invention to protect inert cermet anode electrodes and attached assemblies from thermal shock and chemical reactants. It is another main object of the invention to provide a simplified electrode assembly which contains a minimal of materials, parts and contaminants. These and other objects are accomplished by providing an electrolysis apparatus comprising a plurality of anodes, each anode having a lower portion immersed in molten electrolyte bath, wherein a solid material selected from the group consisting of alumina and cryolite, and mixtures thereof, together with a minor effective amount, about 5 wt. % to 25 wt. % of cementitious binder, said solid material contacting and circumscribing at least an upper portion of at least one of said anodes. The solid material can be applied by molding/casting, dipping, spraying or the like, and can be made that upon dissolution on or very little impurities are introduced into the molten bath.

The invention also provides an electrolysis apparatus comprising an inert anode system comprising at least one inert anode having a lower portion in contact with a molten salt bath, where at least an upper portion of the inert anode contacts and is circumscribed by a solid material subject to attack by gases from the bath, wherein the solid material is selected from the group consisting of alumina-cement and cryolite-alumina, both of which will dissolve in the presence of the molten salt bath. The alumina-cement material is preferably at least 92% pure $Al_2O_3$, insulating and very advantageously, highly temperature resistant. The alumina-cryolite material is preferably about 40 wt. % to 80 wt. % cryolite, at least 2 wt. % alumina and 5 wt. % to 25 wt. % of a high temperature resistant cementitious material. By "cryolite" is meant, sodium aluminum fluoride which may contain various alkali and alkaline earth elements, such as calcium, magnesium, potassium, lithium, and beryllium in various ratios as well as the specific formula $Na_3AlF_6$. Alumina can also be used, as a major component with from 5 wt. % to 15 wt. % heat resistant refractory cementitious material. The alumina-cement structure can, advantageously be formulated to be 50 vol. % to 95 vol. % dense (that is having 5 vol. % to 50 vol. % porosity) allowing air inclusions providing advantages of over 1000° C. preheating before insertion into the bath. The alumina can also contain up to 15 wt. % other oxides, such as, for example, $CaO_2$, $SiO_2$ and others as well as the cement previously mentioned.

DETAILED DESCRIPTION OF THE PREFERRED EMBODIMENTS

Figure 1:
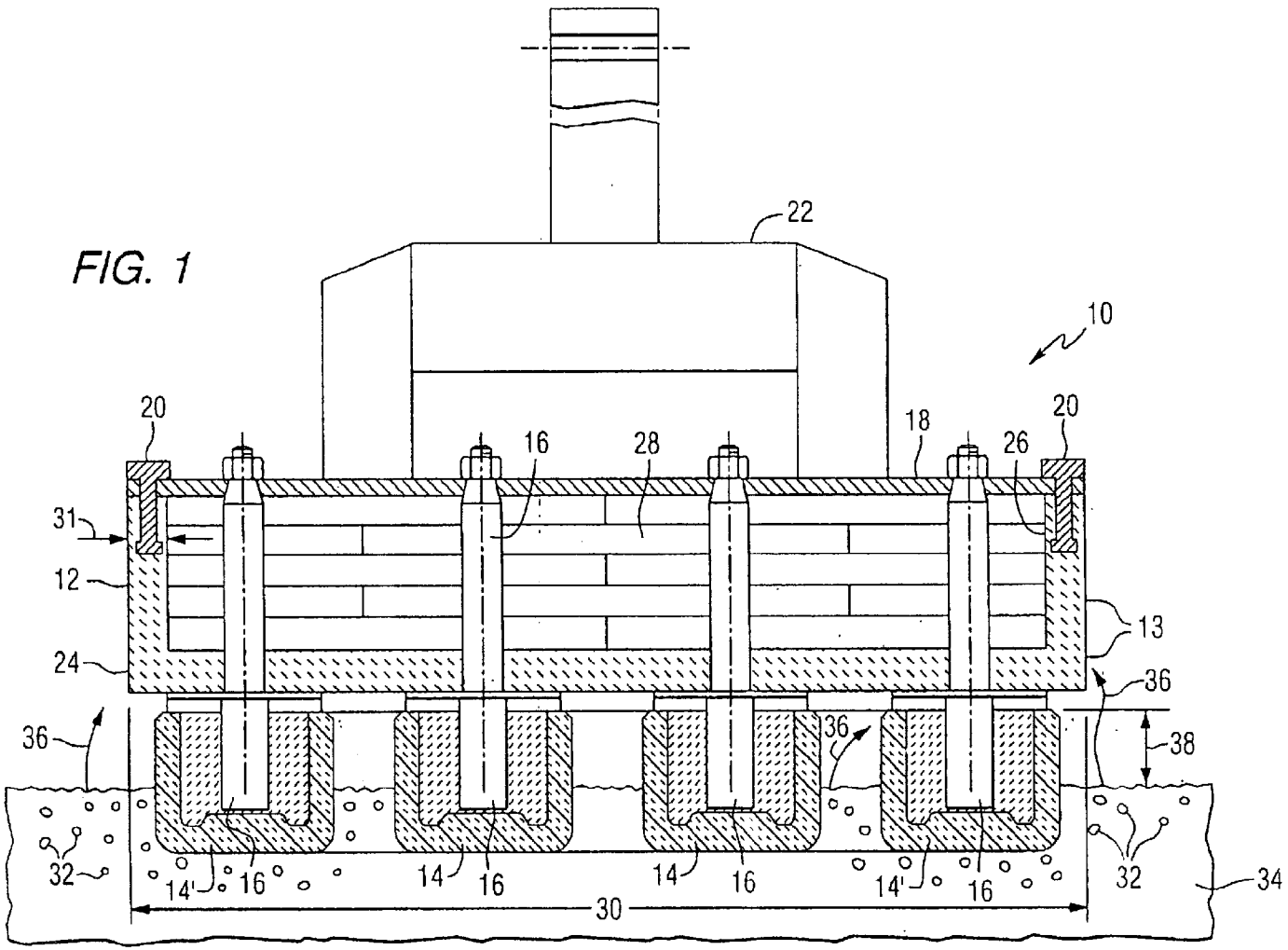
FIG. 1 is a cross-sectional view of one example of an anode system with a plurality of anodes.

Referring now to FIG. 1, an electrolytic cell comprising an inert anode system 10 is shown in an electrolysis apparatus, used for example to produce aluminum, and comprises a top structure and a plurality of inert anodes 14 and 14'. The top structure can include a refractory 12 to which the inert anodes are attached through a plate 18. The refractory material can be a flat structure, or, for example, the hollow box type structure shown, filled with insulation 28. Metal bolts 16 can anchor the inert anodes to the refractory 12 and to a top metal, usually steel plate 18 anchored to the refractory 12 by metal anchors 20 or the like. The entire inert anode system, 12, 18 and 28, is attached to a massive metal holder 22. The inert anode system can be quite large, with the length 30 of the refractory being from about 1 to 2 m (3 feet to 6 feet), and the wall thickness 31 being from about 2 cm to 10 cm. The refractory 12 has an outer or exterior side 24 as shown, and can have an interior side 26. The interior of the refractory 12 can be filled with layers of low density ceramic boards 28 as shown, or insulating mat made from ceramic fibers, or other materials, or left hollow. As can be seen, this type of system is quite complicated in construction.

Gases 32 from the molten salt bath 34 and anode 14, 14' are very aggressive even to stainless steel, especially several gases in combination. The gases shown as circles (bubbles) 32 from either the bath or the anodes 14' (only gas from the two outer anodes are shown for sake of simplicity) pass above the bath 34 as the gas flow arrows 36. The molten salt bath 34 usually used in the Hall process to produce aluminum is based on molten cryolite (as NaF plus $AlF_3$), at a bath weight ratio of NaF to $AlF_3$ in a range of about 1.0:1 to 1.6:1 and at a temperature usually from about 850° C. to 1050° C., preferably from 950° C. to 975° C. Additionally, bath additives can be added for various purposes. The inert anodes are not totally immersed in the molten bath, usually the top edge of the anode is above the bath a distance 38, usually about 5 cm to 30 cm, called the gas or vapor space. The gases 32 most commonly generated include HF, $AlF_3$, $O_2$, and $NaAlF_4$. A combination of HF and $O_2$ is particularly corrosive to metals and ceramics especially at temperatures over about 400° C. Oxygen is generated at the anodes according to the reaction:

$$2Al_2O_3\ (soln)+12e^- \rightarrow 4Al\ (liquid)+3O_2\ (gas) \qquad (I)$$

and HF is generated from the bath according to the reaction (II):

$$2AlF_3\ (soln)+3H_2O \rightarrow Al_2O_3\ (soln)+6\ HF\ (gas) \qquad (II).$$

The source of water is the chemically bound water intrinsic to the smelting grade alumina fed to the smelting cell. The temperature of the refractory 12 at points 13 where there might be HF and $O_2$ contact is about 700° C. to 1000° C. depending on the distance from the molten cryolite.

Figure 2:
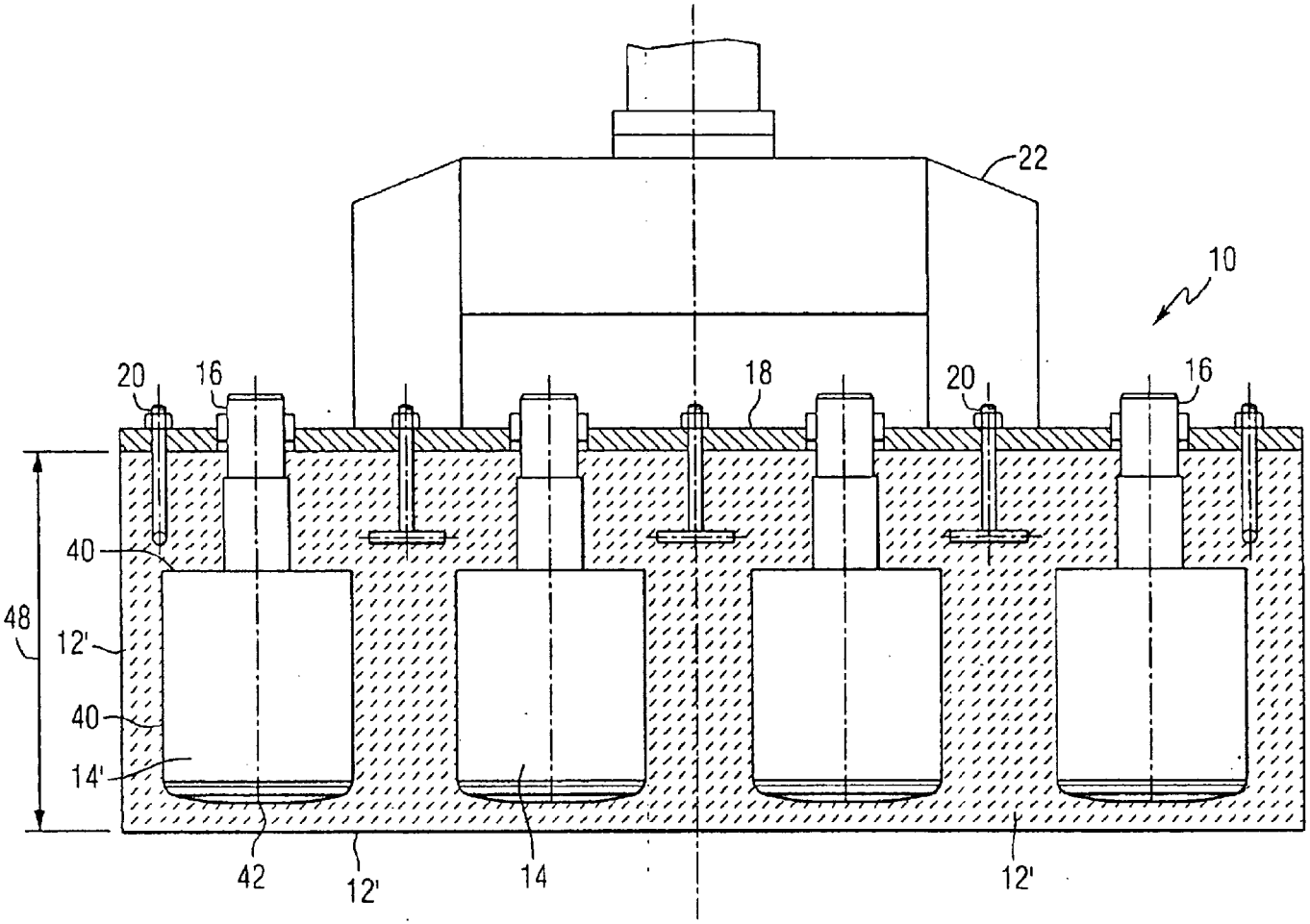
FIG. 2 which best shows the invention, is a plan view, partly in section, of an anode system with a plurality of anodes used for example in aluminum processing, where the anodes are attached to and circumscribed by a solid block comprising cryolite and/or alumina.

Referring now to FIG. 2, one embodiment of the simpler and preferred inert anode system 10 of this invention is shown as assembled and, in the instance shown, cast, before contact with the molten electrolyte. As can be seen, the system 10 also contains a plurality of inert anodes 14 and 14', and a circumscribing support material 12'. An attached metal plate 18 is secured by a number of anchors 20 all held by massive metal holder 22. Here, a dramatically different anode circumscribing solid structure 12', heretofore not considered, is used, which contacts the anodes 14 and 14' at points 40 and 42 when the solid structure 12' is first cast, before insertion into an electrolysis apparatus. Comparison with FIG. 1 shows the simplicity of this new system.

Figure 3:
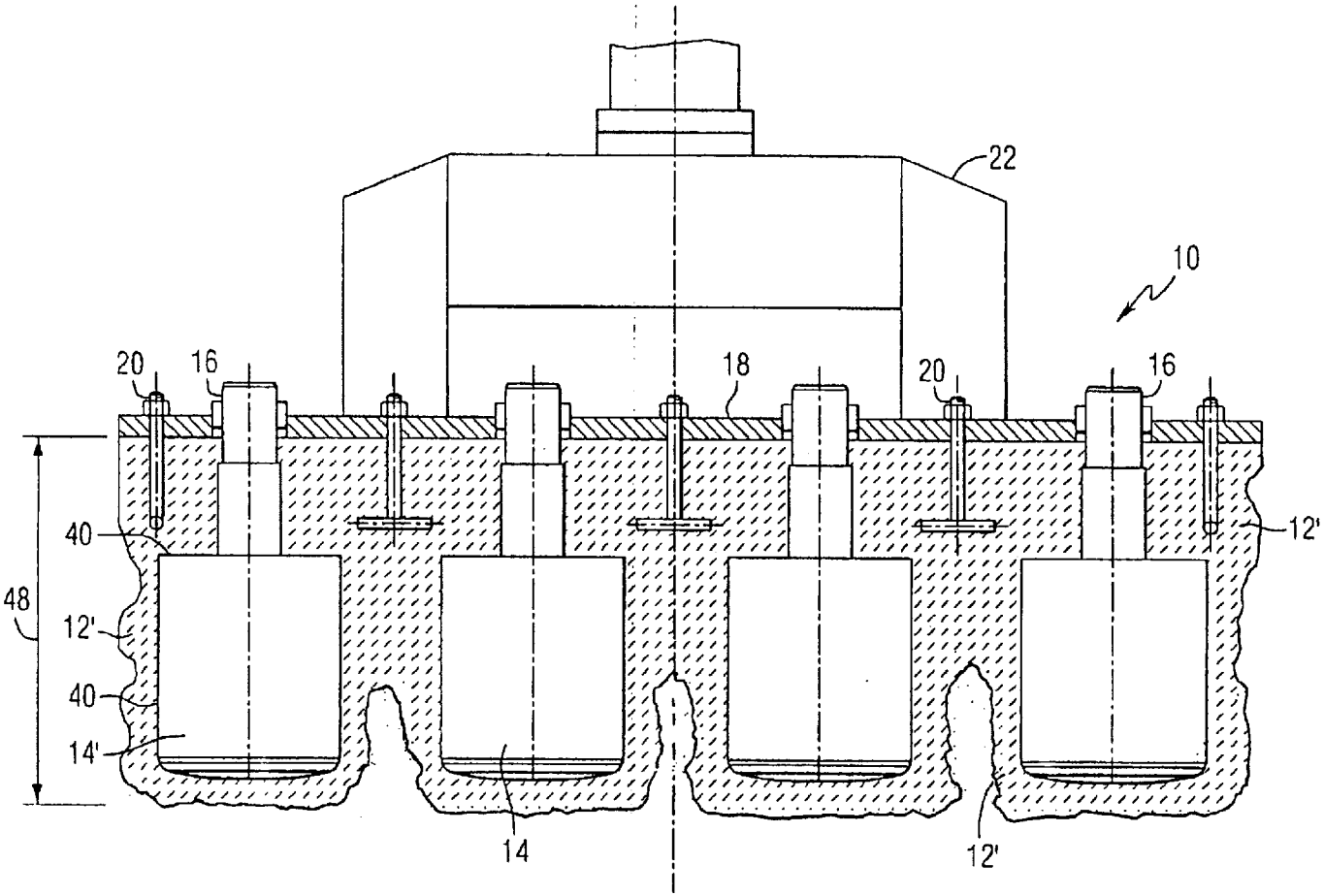
FIG. 3 is a plan view, partly in section, similar to FIG. 2, but with a spray or dip application to provide material also circumscribing the entire portion of the anodes, but not in block form.

FIG. 3 shows, basically, the same design and circumscribing result, as FIG. 2, but application of the solid structure 12 by a dipping or spraying means where the solid structure 12' will still completely fill in between the inert anodes such as 14 and 14'. While not as uniform an outside structure, the application is cost effective, serves the same purpose as a neat, uniform casting/molding operation shown in FIG. 2, is lighter and uses less material.

Figure 4:
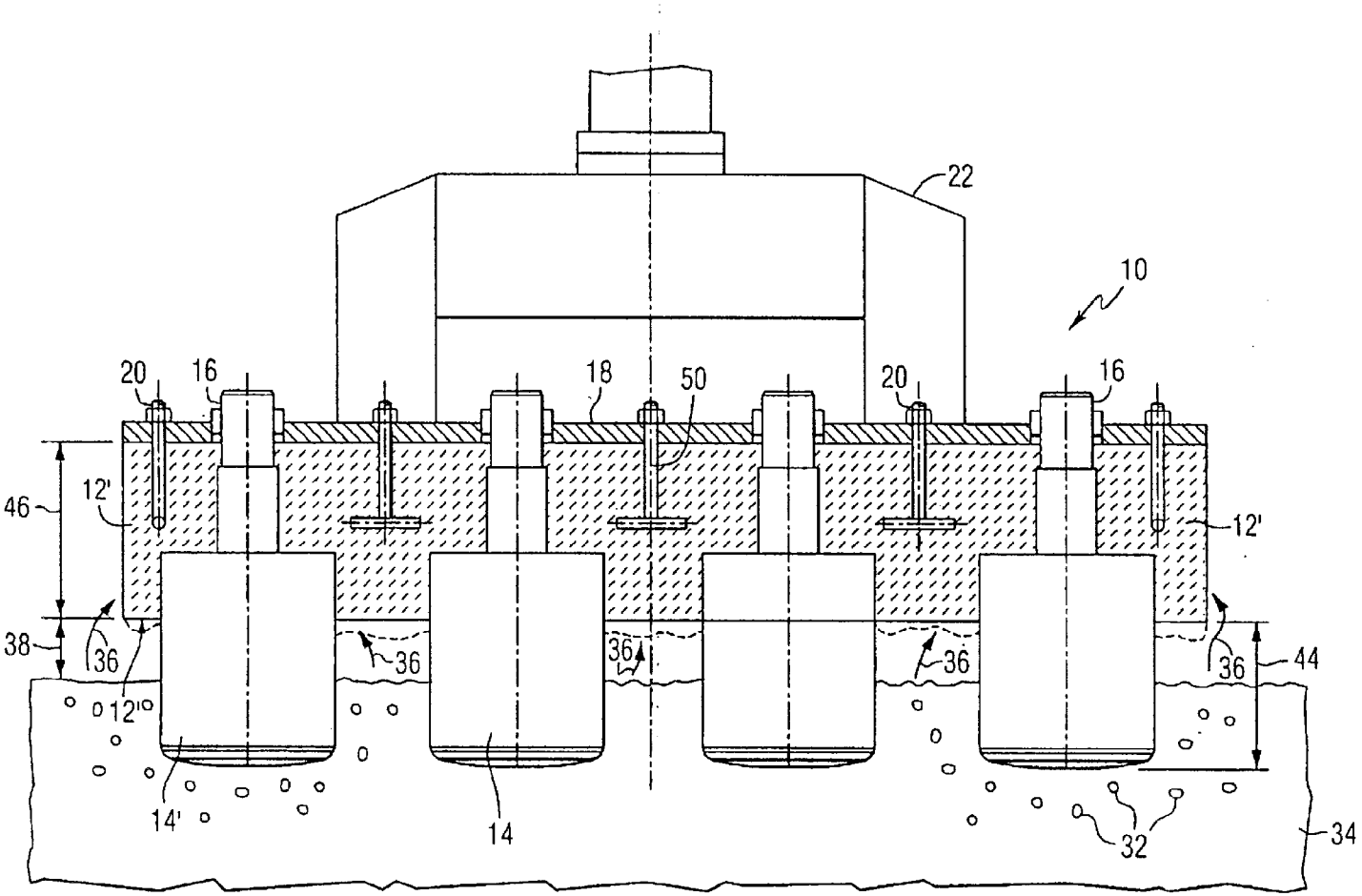
FIG. 4 is a plan view, partly in sections, of the system of FIGS. 2 and 3 after substantial contact with a molten salt bath, showing partial dissolution of the circumscribing solid block.

FIG. 4 shows the system 10 of FIGS. 2 or 3 inserted into an electrolysis apparatus, such as could be used to produce aluminum, where molten cryolite 34 (comprising $Na_3AlF_6$) contacts the inert anodes 14 and 14' and has dissolved a portion of the reduced solid material 12' a distance 44 from the bottom of anodes 14 and 14' leaving a remaining solid material thickness 46. The remaining thickness 46 can be from 30% to 80% preferably from 40% to 70% of the original solid structure thickness 48, shown in FIGS. 2 and 3. FIG. 4 shows a remaining solid structure thickness of 50%, although for the dipped or sprayed coating the surface would be a little rougher than shown and from 3 to possibly 5 or more repetitions may be required to get the desired block type shape. A remaining solid structure thickness of less than 30% will weaken the entire inert anode system 10 and impair the insulating effect of the solid material 12'. A remaining solid structure thickness greater than about 80% will not provide sufficient anode surface to allow the cell to function properly. Over a certain vapor space 38, cryolite 34 from the bath will condense and solidify on the bottom of the solid structure 12', in a steady state operation, adding additional solid structure as shown by the dotted lines.

In this invention the entire refractory slab, insulating boards, protective outer inert anode coatings/coverings, all of which dissolved to a certain extent into the molten bath causing impurities, are replaced with a block of either alumina, preferably 95 wt. % to 99 wt. % pure, or bath+alumina material, both of which contain a binder cement, to provide the solid structure 12' shown in FIGS. 2 and 3. If the surrounding alumina or bath+alumina support 12' dissolves into the molten cryolite bath 34 no harm is done and, no more than 0.5 wt. % impurities based on molten bath weight, or preferably no impurities are added to the molten bath. This also simplifies the structure of the entire system 10 dramatically, with substantial time and cost savings. It also makes anode alignment much less critical in the assembly process. This solid block material 12' initially totally encloses the anodes 14, 14' and bolts 16, and is suspended by hangers 50 from the steel plate 18. The alumina content of the block is adjusted to allow the assembly to withstand preheating temperatures. Also, in the cryolite +alumina material, the bath weight ratio ($NaF \div AlF_3$) is preferably about 1.2 to 1.6 to withstand preheat temperatures. When the anode is set, some of the solid material 12' dissolves in the bath, exposing the lower part of the anode for electrolysis, while the upper part remains solid, like a natural crust, to provide insulation and protection from fumes. This crust will grow and shrink as the anode is raised and lowered, providing continuous protection and insulation. When the system 10 is set in the molten bath 34, as shown in FIG. 4, it automatically provides the only two materials which need be added to the bath: alumina and more bath to fill the gaps between anodes 14 and 14'. Normally, commercial aluminum can have a maximum of about 0.3 to 0.65% impurities; where the allowable range of each impurity is from about 0.1% to 0.6% Fe; 0% to 0.05% Cu; 0% to 0.05% Zn; 0% to 0.05% Ni; and 0% to 0.35% Si. Use of alumina, $Al_2O_3$, or bath +alumina support, plus, in both cases, any associated alumina based cement material will allow the production of commercial grade aluminum.

The more complicated material composition containing bath+alumina solid structure 12' will now be discussed. The castable bath+alumina solid structure 12' usually comprises from about 40 wt. % to about 80 wt. %, preferably from about 55 wt. % to about 70 wt. % sodium aluminum fluoride powder; from about 2 wt. % to about 25 wt. %, preferably about 2 wt. % to about 10 wt. % aluminum oxide powder ($Al_2O_3$). The materials usually contain a minor effective amount of binder, usually from about 5 wt. % to about 25 wt. %; preferably from about 5 wt. % to about 15 wt. % of a cementitious material preferably an alumina based refractory cementitious material/cement, preferably containing from about 65 wt. % to 85 wt. % alumina ($Al_2O_3$) and 15 wt. % to 30 wt. % CaO. This cementitious material is a high temperature resistant material capable of resisting temperatures of from 800° C. to 1200° C. without degredation. Besides alumina the usual components could include for example CaO, $SiO_2$, $Na_2O$, and $Fe_2O_3$. The structure 12' may also contain minor amounts of $Na_5Al_3F_{14}$ (natural chiolite). Water is added to the powder mixture to make a slurry and then approximately 10 wt. % based on the entire powder mixture of the alumina based cementitious material is added to bind the bath+alumina material together. This bath material+cement slurry is then poured into a mold containing the inert anodes 14, 14' and hangers 50, followed by baking at approximately 125° C. to 175° C. for 10 hours to 15 hours to remove moisture. This provides a less porous, less temperature resistant structure than the purified alumina +cement structure, but is still preferred as chemically more similar to the electrolyte.

The alumina material can be molded, cast, dipped or sprayed. It is essentially pure $Al_2O_3$ alone or mixed with a suitable cementitious binder based on alumina, with from about 5 wt. % to about 15 wt. % heat resistant, high temperature (capable of resisting temperatures of from about 800° C. to 1200° C. without degredation) cementitious material.

EXAMPLES

An anode system was provided with a solid circumscribing material containing a mixture of cryolite, calcium aluminate cement and dispersant as described below.

About 5,400 grams of 0.05–1.0 millimeter calcium aluminate cement/grog, was mixed with about 600 grams of calcium aluminate, 100 grams of Methocel (dispersant), 100 grams of a Bentonite Clay wetting agent, and 1200 grams of–200 mesh Hall bath Cryolite having a ratio of 0.90 to 1.50 (% Sodium Fluoride to % Aluminum Fluoride), and then, mixed with from 1000 grams to 7000 grams of water (on average 3888 grams).

All solid ingredients were mixed, in a stainless steel mixing bowl, for 2 to 5 minutes on a dry basis at low speeds. The water was slowly added to the mixed powders. The mixing process was stopped periodically to insure that all ingredients were wet and evenly dispersed or not settled on the bottom of the mixing bowl.

The water base mixture was then transferred to a container, to allow anodes to be dip coated with an up to ½ inch (1.27 cm) thick coat of the mixture. In the dip coating process, anodes were lowered slowly into the mixture refractory coating until completely submerged. The coating was allowed to equilibrate (that is, even out in the area that was in immediate contact with the anodes). The anodes were then pulled out at a rate of about 12.5 cm/minute to allow at least a 0.6 cm thick coat of the bath block refractory to adhere to the surface of the anodes.

The anodes were then suspended from a fixture and a hot air dryer is used to accelerate the drying of the bath block coating. Once the outer surface was dry to the touch, the anodes were submerged for the second and third coat, as required, for specified coating applications with the appropriate drying step before the application of the next coat. To get a complete block structure several more applications would be required.

The anodes having the desired coating thickness were then placed in a preheating furnace, and heated to approximately 960° C. at a rate to prevent cracking of the anode and insulating coating. Once at a desired temperature, the coated anodes were removed from the heater and quickly transferred to a Hall Cell with a loss of less than 10° C. in temperature in less than the 2 minutes required to transfer the anodes into the Hall Cell.

Upon submersion into the Hall Cell the bath block coating was dissolved up to the birth line in less than 5 minutes. The dissolution of the bath block from the submerged portion of the anode allowed current to flow for the production of aluminum metal. Importantly, the dissolved bath block insulation was of such composition that it didn't contaminate the metal or the cryolite used in the Hall Cell. This provided a simple, inexpensive compatible anode support useful for aluminum production.

Having described the presently preferred embodiments, it is to be understood that the invention may be otherwise embodied within the scope of the appended claims.

What is claimed is:

1. An electrolysis apparatus operating to produce aluminum comprising: a plurality of anodes each attached to a top plate by a metal bolt extending from the top plate to the anode top, each anode having a lower portion immersed in a cryolite-based molten electrolyte bath, and a solid material selected from the group consisting of alumina and cryolite, and mixtures thereof, together with an effective amount of cementitious binder, said solid material contacting and having a thickness to completely circumscribe said anodes, where the solid material dissolves into the molten electrolyte during electrolysis to the extent the remaining solid material thickness is from 30% to 80% of the original thickness yet still circumscribes the top sides of the anodes, leaving the lower portion of the anodes free to contact the bath.

2. The electrolysis apparatus of claim 1, wherein the anodes are inert anodes, and the solid material is of such a composition that its dissolution does not contaminate the bath, or aluminum produced.

3. The electrolysis apparatus of claim 1 wherein the top plate is metal.

4. The electrolysis apparatus of claim 1 where the solid material comprises from about 40 wt. % to about 80 wt. % cryolite, about 2 wt. % to about 25 wt. % alumina and from about 5 wt. % to about 25 wt. % of cementitious binder material.

5. The electrolysis apparatus of claim 1, wherein the solid material comprises alumina containing from 5 wt. % to 15 wt. % of cementitious binder material.

6. The electrolysis apparatus of claim 1, wherein the solid material will dissolve at temperatures of about 1000° C. in the presence of a cryolite-based molten electrolyte bath.

7. The electrolysis apparatus of claim 1, wherein the solid material will dissolve to the extent where the remaining solid material thickness is from 30% to 80% of the original thickness.

8. An electrolysis apparatus operating to produce aluminum comprising an inert anode system comprising: at least one inert anode attached to a top plate by a metal bolt extending from the top plate to the inert anode top, the inert anode having a lower portion immersed in a cryolite-based molten salt electrolyte bath, where the at least one inert anode contacts and is completely circumscribed by a solid material having a thickness to completely circumscribe said at least one anode, said solid material subject to attack by gases from the bath, wherein the solid material is selected from the group consisting of alumina-based cement and cryolite-alumina, both of which will dissolve into the molten salt bath in the presence of tile molten salt bath during electrolysis to the extent the remaining solid material thickness is from 30% to 80% of the original thickness yet still circumscribes the top sides of the at least one inert anode, leaving the lower portion of the at least one anodes free to contact the bath.

9. The electrolysis apparatus of claim 8 where the solid material is about 40 wt. % to 80 wt. % cryolite, about 2 wt. % to 25 wt. % alumina, and 5 wt. % to 25 wt. % of a cementitious material.

10. The electrolysis apparatus of claim 10, wherein the solid material will dissolve to the extent that the remaining solid material thickness is from 40% to 70% of the original support thickness, and the solid material is of such a composition that its dissolution does not contaminate the bath, or aluminum produced.

11. The electrolysis apparatus of claim 8, wherein the cement material is an alumina based refractory cement.

12. The electrolysis apparatus of claim 8, where the solid material is applied by casting.

13. The electrolysis apparatus of claim 8, where the solid material is applied by spraying.

14. The electrolysis apparatus of claim 8, where the solid material is applied by dipping.

* * * * *

UNITED STATES PATENT AND TRADEMARK OFFICE

CERTIFICATE OF CORRECTION

PATENT NO. : 6,818,106 B2
APPLICATION NO. : 10/713798
DATED : November 16, 2004
INVENTOR(S) : LeRoy E. D'Astolfo and Calvin Bates It is certified that error appears in the above-identified patent and that said Letters Patent is hereby corrected as shown below:

Column 7, line 27: replace "birth line" with --bath line--

Column 8, line 13: remove "." after "1000° C"

Column 8, line 31: replace "tile molten" with --the molten--

Column 8, line 41, replace "claim 10, wherein" with --claim 8, wherein--

Signed and Sealed this

Tenth Day of April, 2007

JON W. DUDAS
*Director of the United States Patent and Trademark Office*